United States Patent [19]

Maskasky

[11] Patent Number: 4,459,353

[45] Date of Patent: Jul. 10, 1984

[54] GAMMA PHASE SILVER IODIDE EMULSIONS, PHOTOGRAPHIC ELEMENTS CONTAINING THESE EMULSIONS, AND PROCESSES FOR THEIR USE

[75] Inventor: Joe E. Maskasky, Rochester, N.Y.

[73] Assignee: Eastman Kodak Company, Rochester, N.Y.

[21] Appl. No.: 451,309

[22] Filed: Dec. 20, 1982

[51] Int. Cl.[3] ..... G03C 1/02

[52] U.S. Cl. ..... 430/567; 430/569; 430/434

[58] Field of Search ..... 430/567, 569, 434

[56] References Cited

PUBLICATIONS

Byerley and Hirsch, "Dispersions of Metastable High Temperature Cubic Silver Iodide," Journal of Photo. Science, vol. 18, 1970, pp. 53–59.

Daubendiek, "AgI Precipitations: Effects of pAg on Crystal Growth (PB), III–23", Papers from the 1978 International Congress of Photographic Science, Rochester, N.Y., pp. 140–143.

*Primary Examiner*—Mary F. Downey

*Attorney, Agent, or Firm*—Carl O. Thomas

[57] ABSTRACT

A silver halide emulsion is disclosed comprised of thin tabular silver iodide grains of a face centered cubic crystal structure. These tabular grains have a high average aspect ratio and account for at least 50 percent of the total projected area of the silver halide grains present in the emulsion. The emulsions are useful in blue recording as well as other layers of photographic elements.

20 Claims, 2 Drawing Figures

1μm

1 μm

GAMMA PHASE SILVER IODIDE EMULSIONS, PHOTOGRAPHIC ELEMENTS CONTAINING THESE EMULSIONS, AND PROCESSES FOR THEIR USE

FIELD OF THE INVENTION

This invention relates to silver halide emulsions containing silver iodide grains, photographic elements incorporating these emulsions, and processes for using the photographic elements.

BACKGROUND OF THE INVENTION

Radiation-sensitive emulsions employed in photography are comprised of a dispersing medium, typically gelatin, containing radiation-sensitive microcrystals—known as grains—of silver halide. The radiation-sensitive silver halide grains employed in photographic emulsions are typically comprised of silver chloride, silver bromide, or silver in combination with both chloride and bromide ions, each often incorporating minor amounts of iodide.

Radiation-sensitive silver iodide emulsions, though infrequently employed in photography, are known in the art. Silver halide emulsions which employ grains containing silver iodide as a separate and distinct phase are illustrated by Steigmann German Pat. No. 505,012, issued Aug. 12, 1930; Steigmann, Photographische Industrie, "Green-and Brown-Developing Emulsions", Vol. 34, pp. 764, 766, and 872, published Jul. 8 and Aug. 5, 1938; Maskasky U.S. Pat. Nos. 4,094,684 and 4,142,900; and Koitabashi et al U.K. Patent Application No. 2,063,499A. Maskasky *Research Disclosure,* Vol. 181, May 1979, Item 18153, reports silver iodide phosphate photographic emulsions in which silver is coprecipitated with iodide and phosphate. A separate silver iodide phase is not reported.

The crystal structure of silver iodide has been studied by crystallographers, particularly by those interested in photography. As illustrated by Byerley and Hirsch, "Dispersions of Metastable High Temperature Cubic Silver Iodide", *Journal of Photographic Science,* Vol. 18, 1970, pp. 53–59, it is generally recognized that silver iodide is capable of existing in three different crystal forms. The most commonly encountered form of silver iodide crystals is the hexagonal wurtzite type, designated $\beta$ phase silver iodide. Silver iodide is also stable at room temperature in its face centered cubic crystalline form, designated $\gamma$ phase silver iodide. A third form of crystalline silver iodide, stable only at temperatures above about 147° C., is the body centered cubic form, designated $\alpha$ phase silver iodide. The $\beta$ phase is the most stable form of silver iodide.

James, *The Theory of the Photographic Process,* 4th Ed., Macmillan, 1977, pp. 1 and 2, contains the following summary of the knowledge of the art:

> According to the conclusions of Kokmeijer and Van Hengel, which have been widely accepted, more nearly cubic AgI is precipitated when silver ions are in excess and more nearly hexagonal AgI when iodide ions are in excess. More recent measurements indicate that the presence or absence of gelatin and the rate of addition of the reactants have pronounced effects on the amounts of cubic and hexagonal AgI Entirely hexagonal material was produced only when gelatin was present and the solutions were added slowly without an excess of either $Ag^+$ or $I^-$. No condition was found where only cubic material was observed.

Tabular silver iodide crystals have been observed. Preparations with an excess of iodide ions, producing hexagonal crystal structures of predominantly $\beta$ phase silver iodide are reported by Ozaki and Hachisu, "Photophoresis and Photo-agglomeration of Plate-like Silver Iodide Particles", *Science of Light,* Vol. 19, No. 2, 1970, pp. 59–71, and Zharkov, Dobroserdova, and Panfilova, "Crystallization of Silver Halides in Photographic Emulsions IV. Study by Electron Microscopy of Silver Iodide Emulsions", Zh. Nauch. Prikl. Fot. Kine, March-April, 1957, 2, pp. 102–105.

Daubendiek, "AgI Precipitations: Effects of pAg on Crystal Growth(PB)", III–23, *Papers from the* 1978 *International Congress of Photographic Science,* Rochester, N.Y., pp. 140–143, 1978, reports the formation of tabular silver iodide grains during double-jet precipitations at a pAg of 1.5. Because of the excess of silver ions during precipitation, it is believed that these tabular grains were of face centered cubic crystal structure. However, the average aspect ratio of the grains was low, being estimated at substantially less than 5:1.

Prior to the present invention a variety of photographic advantages have been recognized to be attributable to silver halide emulsions containing tabular grains of high average aspect ratios. Kofron et al U.S. Ser. No. 429,407 teaches speed-granularity relationship improvements, increased separation of spectrally sensitized and native speeds, and sharpness advantages for high aspect ratio tabular grain emulsions. Kofron et al further teaches increasing the permissible maximum thickness of the tabular grains to 0.5 micron to increase blue light absorption, recognizing that the thinness of tabular grains reduces their light absorbing capacity in the absence of spectral sensitizing dyes. Wilgus and Haefner U.S. Ser. No. 429,420, Daubendiek and Strong U.S Pat. No. 4,414,310, and Solberg, Piggin, and Wilgus U.S. Ser. No. 431,913 disclose the preparation of high aspect ratio tabular grain silver bromoiodide emulsions, the iodide content being limited by its solubility in silver bromide. Thus, no separate silver iodide phase is present. Abbott and Jones U.S. Pat. No. 4,425,425 discloses reductions in crossover and Dickerson U.S Pat. No. 4,414,304 discloses increased covering power at higher levels of hardening in radiographic elements containing high aspect ratio, tabular grain silver halide emulsions. Wey U.S. Pat. No. 4,399,215 and Maskasky U.S. Pat. No. 4,400,463 disclose high aspect ratio tabular, grain silver chloride emulsions. Mignot U.S. Pat. No. 4,386,156, filed Nov. 12, 1981, discloses high aspect ratio tabular silver bromide emulsions wherein the tabular grains have square or rectangular major crystal faces. High aspect ratio tabular grain silver bromide emulsions wherein the grains have hexagonal major crystal faces are disclosed by de Cugnac and Chateau, "Evolution of the Morphology of Silver Bromide Crystals During Physical Ripening", *Science et Industries Photographiques,* Vol. 33, No. 2 (1962), pp. 121–125. Jones and Hill U.S. Ser. No. 430,092 now abandoned in favor of U.S. Ser. No. 553,911, filed Nov. 21, 1983, discloses increased speeds with reduced silver coverages in image transfer film units containing high aspect ratio tabular grain emulsions. Evans et al U.S. Ser. No. 431,912 discloses internal latent image forming high aspect ratio tabular grain silver halide emulsions, showing particular advantages in stability and in protection against rereversal. Wey and Wilgus U.S. Pat. No.

4,414,306 discloses high aspect ratio tabular grain silver chlorobromide emulsions. Maskasky U.S. Ser. No. 431,855 discloses epitaxial deposition onto high aspect ratio tabular silver halide grains, with resulting advantages in sensitivity. All of the copending patent applications patents cited above in this paragraph are commonly assigned and, except for Mignot, the filing date of which is given above, were filed on Sept. 30, 1982. None of these copending, commonly assigned patent applications teach or suggest the use of high aspect ratio tabular grain silver iodide emulsions.

House U.S. Ser. No. 451,366, filed concurrently herewith and commonly assigned, titled MULTICOLOR PHOTOGRAPHIC ELEMENTS CONTAINING SILVER IODIDE EMULSIONS, now abandoned in favor of continuing application Ser. No. 543,656, filed Oct. 19, 1983 discloses investigations of high aspect ratio tabular grain silver iodide emulsions in forming emulsion layers of multicolor photographic elements.

SUMMARY OF THE INVENTION

In one aspect this invention is directed to a high aspect ratio tabular grain silver halide emulsion comprised of a dispersing medium and silver halide grains. At least 50 percent of the total projected area of the silver halide grains is provided by tabular silver iodide grains of a face centered cubic crystal structure having a thickness of less than 0.3 micron and an average aspect ratio of greater than 8:1.

In another aspect, this invention is directed to a photographic element comprised of a support and at least one radiation-sensitive emulsion layer comprised of a radiation-sensitive emulsion as described above.

In still another aspect, this invention is directed to producing a visible photographic image by processing in an aqueous alkaline solution in the presence of a developing agent an imagewise exposed photographic element as described above.

This invention contributes to the knowledge of the art the first high aspect ratio tabular grain silver iodide emulsion wherein the tabular grains are of a face centered cubic crystal structure. Directly attributable to the iodide content of the grains is their advantageously high extinction coefficient (absorption) in a portion of the blue spectrum. In addition this invention also exhibits in relation to nontabular or low aspect ratio tabular grain silver iodide emulsions the known advantages of high aspect ratio tabular grain configuration, discussed above. However, as compared to tabular grains of other halide composition, very thin grains have been obtained. This permits more efficient use of the grains in many applications. For example, higher aspect ratios can be achieved with smaller diameter grains. Thus tabular grain advantages can be extended to high resolution (small grain size) emulsions.

DESCRIPTION OF PREFERRED EMBODIMENTS

Figure 1:
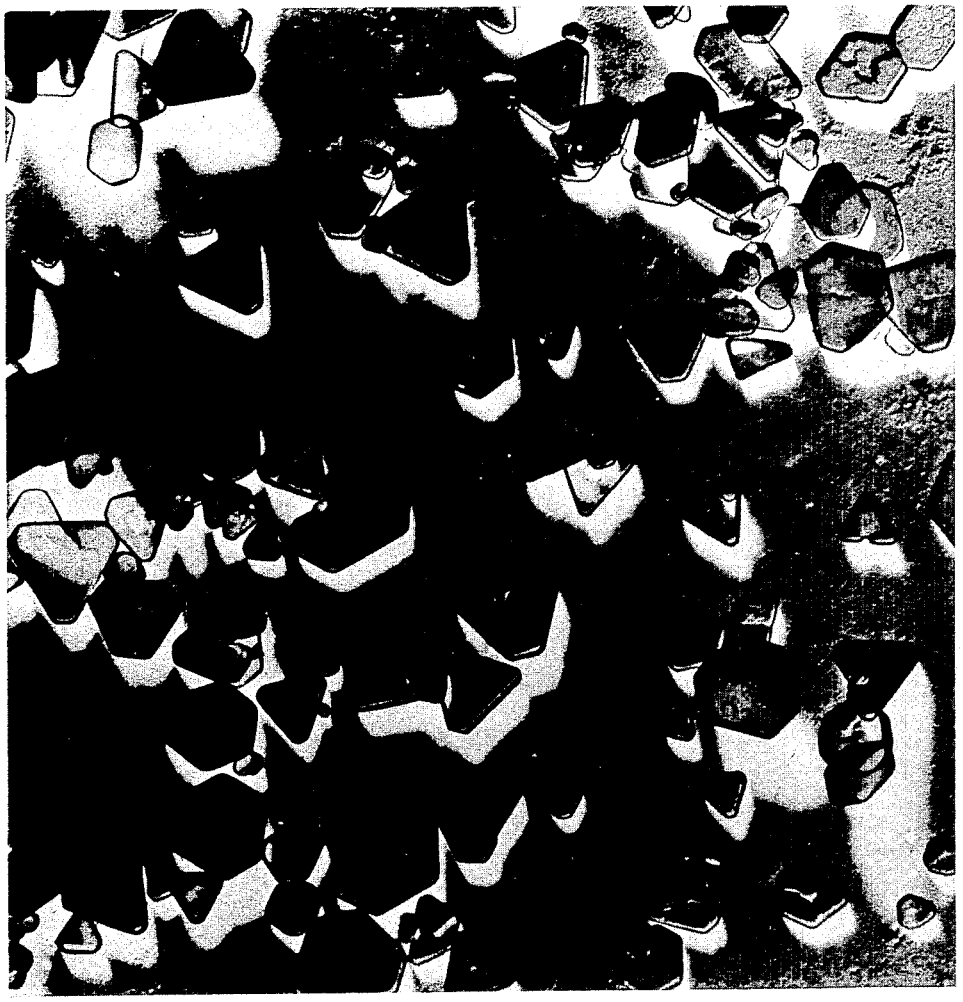
FIGS. 1 and 2 are electron micrographs of emulsion samples.

This invention relates to silver halide emulsions containing high aspect ratio tabular silver iodide grains of a face centered cubic crystal structure, to photographic elements which incorporate these emulsions, and to processes for the use of the photographic elements. As applied to the silver halide emulsions of the present invention the term "high aspect ratio" is herein defined as requiring that the silver iodide grains having a thickness of less than 0.3 micron have an average aspect ratio of greater than 8:1 and account for at least 50 percent of the total projected area of the silver iodide grains.

The preferred silver halide emulsions of the present invention are those wherein the tabular silver iodide grains having a thickness of less than 0.3 micron (optimally less than 0.2 micron) have an average aspect ratio of at least 12:1. Higher average aspect ratios (50:1, 100:1, or higher) are contemplated.

Individual tabular grains have been observed having thicknesses slightly in excess of 0.005 micron, suggesting that preparations of tabular silver iodide grains according to this invention having average thicknesses down to that value or at least 0.01 micron are feasible. I have observed that silver iodide tabular grains can generally be prepared of lesser thicknesses than tabular silver bromoiodide grains, such as those of the copending, commonly assigned patent applications, cited above. Thus, I contemplate tabular silver iodide grains having the minimum average thicknesses ascribed to silver bromoiodide high aspect ratio tabular grains, 0.03 micron, to be readily realizable in preparing tabular silver iodide grains according to the present invention. Choices of tabular grain thicknesses within the ranges indicated to achieve photographic advantages for specific applications are further discussed below.

The grain characteristics, described above, of the emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph (or an electron micrograph) of an emulsion sample. From shadowed electron micrographs of emulsion samples it is possible to determine the thickness and diameter of each grain and to identify those tabular grains having a thickness of less than 0.3 micron. From this the aspect ratio of each such tabular grain can be calculated, and the aspect ratios of all the tabular grains in the sample meeting the less than 0.3 micron thickness criterium can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the silver iodide grains meeting the thickness and diameter criteria can be summed, the projected areas of the remaining silver iodide grains in the photomicrograph can be summed separately, and from the two sums the percentage of the total projected area of the silver iodide grains provided by the grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. At lower diameters it is not always possible to distinguish tabular and nontabular grains in micrographs. The tabular grains for purposes of this disclosure are those which are less than 0.3 micron in thickness and appear tabular at 40,000 times magnification as viewed employing an electron microscope. The term "projected area" is used in the same sense as the terms "projection area" and "projective area" commonly employed in the art; see, for example, James and Higgins, *Fundamentals of Photographic Theory,* Morgan and Morgan, N.Y., Silver halide emulsions containing high aspect ratio silver iodide tabular grains of face centered cubic structure according to the present invention can be prepared by modifying conventional double-jet silver halide precipitation procedures. As noted by James, *The Theory of the Photographic Process,* cited above, precipitation on the silver side of the equivalence point (the point at which silver and iodide ion concentrations are equal) is important to achieving face centered cubic crystal structures. For example, it is preferred to precipitate at a pAg in the vicinity of 1.5, as undertaken by Daubendiek, cited above. (As employed herein pAg is the negative logarithm of silver ion concentration.) Second, in comparing the processes employed in preparing the high aspect ratio tabular grain silver iodide emulsions of this invention with the unpublished details of the process employed by Daubendiek to achieve relatively low aspect ratio silver iodide grains, I have noted that the flow rates for silver and iodide salt introductions in relation to the final reaction vessel volume I employed were approximately an order of magnitude lower than those of Daubendiek. Thus, I consider the use of relatively low flow rates in relation to the final emulsion volume, such as those employed in the Examples below, to be a second important factor in achieving high aspect ratio tabular grain silver iodide emulsions according to the present invention.

It is believed that the Examples below considered in conjunction with the prior state of the art adequately teach the precipitation of emulsions according to the present invention. Double-jet silver halide precipitation (including continuous removal of emulsion from the reaction vessel) is taught by *Research Disclosure,* Vol. 176, Dec. 1978, Item 17643, Paragraph I, and the patents and publications cited therein. *Research Disclosure* and its predecessor, *Product Licensing Index,* were publications of Industrial Opportunities Ltd.; Homewell, Havant; Hampshire, P09 1EF, United Kingdom. *Research Disclosure* is now published at Emsworth Studios, 535 West End Avenue, New York, N.Y. 10024. Subject to modifications of halide content, pAg, and introduction flow rates, the double-jet precipitation techniques disclosed by Kofron et al, cited above, the details of which are here incorporated by reference, can be applied to the preparation of emulsions according to the present invention.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, Jun. 1975, Item 13452.

It has been discovered that small amounts of phosphate anions can increase the size of the tabular silver iodide grains obtained. Phosphate anion concentrations below 0.1 molar are shown to be useful in the examples below.

In forming the tabular grain emulsions a dispersing medium is initially contained in the reaction vessel. In a preferred form the dispersing medium is comprised of an aqueous peptizer suspension. Peptizer concentrations of from 0.2 to about 10 percent by weight, based on the total weight of emulsion components in the reaction vessel, can be employed It is common practice to maintain the concentration of the peptizer in the reaction vessel in the range of below about 6 percent, based on the total weight, prior to and during silver iodide grain formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver iodide, preferably about 10 to 30 grams of peptizer per mole of silver iodide. Additional vehicle can be added later to bring the concentration up to as high as 1000 grams per mole of silver iodide. Preferably the concentration of vehicle in the finished emulsion is above 50 grams per mole of silver iodide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver iodide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

The high aspect ratio tabular grain emulsions of the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pp. 181–185; by diafiltration with a semipermeable membrane, as illustrated by *Research Disclosure,* Vol. 102, Oct. 1972, Item 10208, Hagemaier et al *Research Disclosure,* Vol. 131, Mar. 1975, Item 13122, Bonnet *Research Disclosure,* Vol. 135, Jul. 1975, Item 13577, Berg et al German OLS No. 2,436,461, Bolton U.S. Pat. No. 2,495,918, and Mignot U.S. Pat. No. 4,334,012, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, Sept. 1972, Item 10152. In the present invention washing is particularly advantageous in terminating ripening of the tabular grains after the completion of precipitation to avoid increasing their thickness and reducing their aspect ratio.

Although the procedures for preparing tabular silver iodide grains described above will produce high aspect ratio tabular grain emulsions in which the tabular grains account for at least 50 percent of the total projected area of the total silver halide grain population, it is recognized that further advantages can be realized by increasing the proportion of such tabular grains present. Preferably at least 70 percent (optimally at least 90 percent) of the total projected area is provided by tabular silver iodide grains. While minor amounts of nontabular grains are fully compatible with many photographic applications, to achieve the full advantages of tabular grains the proportion of tabular grains can be increased. Larger tabular silver iodide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

The high aspect ratio tabular grain silver halide emulsions of this invention can be sensitized by conventional techniques for sensitizing silver iodide emulsions. A preferred chemical sensitization technique is to deposit a silver salt epitaxially onto the tabular silver iodide grains. The epitaxial deposition of silver chloride onto silver iodide host grains is taught by Maskasky U.S. Pat. Nos. 4,094,684 and 4,142,900, and the analogous deposition of silver bromide onto silver iodide host grains is taught by Koitabashi et al U.K. Pat. No. Application 2,063,499A, each cited above and here incorporated by reference.

It is specifically preferred to employ the high aspect ratio tabular silver iodide grains as host grains for epitaxial deposition. The terms "epitaxy" and "epitaxial" are employed in their art recognized sense to indicate that the silver salt is in a crystalline form having its orientation controlled by the host tabular grains. The techniques described in Maskasky U.S. Ser. No. 431,855, cited above and here incorporated by reference, are directly applicable to epitaxial deposition on the silver iodide host grains of this invention. While it is specifically contemplated that the silver salt epitaxy can be located at any or all of the surfaces the host silver iodide grains, the silver salt epitaxy is preferably substantially excluded in a controlled manner from at least a portion of the (111) major crystal faces of the tabular host grains. The tabular host silver iodide grains generally direct epitaxial deposition of silver salt to their edges and/or corners.

By confining epitaxial deposition to selected sites on the tabular grains an improvement in sensitivity can be achieved as compared to allowing the silver salt to be epitaxially deposited randomly over the major faces of the tabular grains. The degree to which the silver salt is confined to selected sensitization sites, leaving at least a portion of the major crystal faces substantially free of epitaxially deposited silver salt, can be varied widely without departing from the invention. In general, larger increases in sensitivity are realized as the epitaxial coverage of the major crystal faces decreases. It is specifically contemplated to confine epitaxially deposited silver salt to less than half the area of the major crystal faces of the tabular grains, preferably less than 25 percent, and in certain forms, such as corner epitaxial silver salt deposits, optimally to less than 10 or even 5 percent of the area of the major crystal faces of the tabular grains. In some embodiments epitaxial deposition has been observed to commence on the edge surfaces of the tabular grains. Thus, where epitaxy is limited, it may be otherwise confined to selected edge sensitization sites and effectively excluded from the major crystal faces.

The epitaxially deposited silver salt can be used to provide sensitization sites on the tabular host grains. By controlling the sites of epitaxial deposition, it is possible to achieve selective site sensitization of the tabular host grains. Sensitization can be achieved at one or more ordered sites on the tabular host grains. By ordered it is meant that the sensitization sites bear a predictable, nonrandom relationship to the major crystal faces of the tabular grains and, preferably, to each other. By controlling epitaxial deposition with respect to the major crystal faces of the tabular grains it is possible to control both the number and lateral spacing of sensitization sites.

In some instances selective site sensitization can be detected when the silver iodide grains are exposed to radiation to which they are sensitive and surface latent image centers are produced at sensitization sites. If the grains bearing latent image centers are entirely developed, the location and number of the latent image centers cannot be determined. However, if development is arrested before development has spread beyond the immediate vicinity of the latent image center, and the partially developed grain is then viewed under magnification, the partial development sites are clearly visible. They correspond generally to the sites of the latent image centers which in turn generally correspond to the sites of sensitizaton.

The sensitizing silver salt that is deposited onto the host tabular grains at selected sites can be generally chosen from among any silver salt capable of being epitaxially grown on a silver halide grain and heretofore known to be useful in photography. The anion content of the silver salt and the tabular silver halide grains differ sufficiently to permit differences in the respective crystal structures to be detected. It is specifically contemplated to choose the silver salts from among those heretofore known to be useful in forming shells for core-shell silver halide emulsions. In addition to all the known photographically useful silver halides, the silver salts can include other silver salts known to be capable of precipitating onto silver halide grains, such as silver thiocyanate, silver cyanide, silver carbonate, silver ferricyanide, silver arsenate or arsenite, silver phosphate or pyrophosphate, and silver chromate. Silver chloride is a specifically preferred sensitizer. Depending upon the silver salt chosen and the intended application, the silver salt can usefully be deposited in the presence of any of the modifying compounds described above in connection with the tabular silver iodide grains. Silver salt concentrations as low as about 0.05 mole percent, preferably at least 0.5 mole percent, based on total silver present in the composite sensitized grains are contemplated. Some iodide from the host grains may enter the silver salt epitaxy. Complete shelling of the silver iodide host grains with silver salt is contemplated, and in this instance silver salt concentrations can be in the conventional shell to core grain ratios. It is also contemplated that the host grains can contain anions other than iodide up to their solubility limit in silver iodide, and, as employed herein, the term "silver iodide grains" is intended to include such host grains.

Conventional chemical sensitization can be undertaken prior to controlled site epitaxial deposition of silver salt on the host tabular grain or as a following step. When silver chloride and/or silver thiocyanate is deposited, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites. Substantially optimum sensitization of tabular silver iodide emulsions have been achieved by the epitaxial deposition of silver chloride without further chemical sensitization.

Any conventional technique for chemical sensitization following controlled site epitaxial deposition can be employed. In general chemical sensitization should be undertaken based on the composition of the silver salt deposited rather than the composition of the host tabular grains, since chemical sensitization is believed to occur primarily at the silver salt deposition sites or perhaps immediately adjacent thereto. Conventional techniques for achieving noble metal (e.g., gold) middle chalcogen (e.g., sulfur, selenium, and/or tellurium), or reduction sensitization as well as combinations thereof are disclosed in *Research Disclosure, Item* 17643, cited above, Paragraph III.

When blue light absorption is contemplated, no spectral sensitization step following chemical sensitization is required. However, in a variety of instances spectral sensitization during or following chemical sensitization is contemplated. Useful spectral sensitizers are disclosed in *Research Disclosure,* Item 17643, cited above, paragraph IV.

The selective siting of epitaxy on the silver iodide host grains can be improved by the use of adsorbed site directors, such as disclosed in Maskasky U.S. Ser. No. 431,855, cited above, and here incorporated by reference. Such adsorbed directors can, for example, more narrowly restrict epitaxial deposition along the edges of the host grains or restrict epitaxial deposition to the corners of the grains, depending upon the specific site director chosen.

Preferred adsorbed site directors are aggregating spectral sensitizing dyes. Such dyes exhibit a bathochromic or hypsochromic increase in light absorption as a function of adsorption on silver halide grains surfaces. Dyes satisfying such criteria are well known in the art, as illustrated by T. H. James, *The Theory of the Photographic Process,* 4th Ed., Macmillan, 1977, Chapter 8 (particularly, F. Induced Color Shifts in Cyanine and Merocyanine Dyes) and Chapter 9 (particularly, H. Relations Between Dye Structure and Surface Aggregation) and F. M. Hamer, *Cyanine Dyes and Related Compounds,* John Wiley and Sons, 1964, Chapter XVII (particularly, F. Polymerization and Sensitization of the Second Type). Merocyanine, hemicyanine, styryl, and oxonol spectral sensitizing dyes which produce H aggregates (hypsochromic shifting) are known to the art, although J aggregates (bathochromic shifting) are not common for dyes of these classes. Preferred spectral sensitizing dyes are cyanine dyes which exhibit either H or J aggregation.

In a specifically preferred form the spectral sensitizing dyes are carbocyanine dyes which exhibit J aggregation. Such dyes are characterized by two or more basic heterocyclic nuclei joined by a linkage of three methine groups. The heterocyclic nuclei preferably include fused benzene rings to enhance J aggregation. Preferred heterocyclic nuclei for promoting J aggregation are quinolinium, benzoxazolium, benzothiazolium, benzoselenazolium, benzimidazolium, napthooxazolium, naphthothiazolium, and napthoselenazolium quaternary salts.

Specific preferred dyes for use as adsorbed site directors in accordance with this invention are illustrated by the dyes listed below in Table I.

TABLE I

| Illustrative Preferred Adsorbed Site Directors | |
|---|---|
| AD-1 | Anhydro-9-ethyl-3,3'-bis(3-sulfopropyl)-4,5,4',5'-dibenzothiacarbocyanine hydroxide, |
| AD-2 | Anhydro-5,5'-dichloro-9-ethyl-3,3'-bis(3-sulfobutyl)thiacarbocyanine hydroxide |
| AD-3 | Anhydro-5,5',6,6'-tetrachloro-1,1'-diethyl-3,3'-bis(3-sulfobutyl)benzimidazolocarbocyanine hydroxide |
| AD-4 | Anhydro-5,5',6,6'-tetrachloro-1,1',3-triethyl-3'-(3-sulfobutyl)benzimidazolocarbocyanine hydroxide |
| AD-5 | Anhydro-5-chloro-3,9-diethyl-5'-phenyl-3'-(3-sulfopropyl)oxacarbocyanine hydroxide |
| AD-6 | Anhydro-5-chloro-3',9-diethyl-5'-phenyl-3-(3-sulfopropyl)oxacarbocyanine hydroxide |
| AD-7 | Anhydro-5-chloro-9-ethyl-5'-phenyl-3,3'-bis(3-sulfopropyl)oxacarbocyanine hydroxide |
| AD-8 | Anhydro-9-ethyl-5,5'-diphenyl-3,3'-bis(3-sulfobutyl)oxacarbocyanine hydroxide |
| AD-9 | Anhydro-5,5'-dichloro-3,3'-bis(3-sulfopropyl)thiacyanine hydroxide |
| AD-10 | 1,1'-Diethyl-2,2'-cyanine p-toluenesulfonate |

Once high aspect ratio tabular grain emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

Dickerson, cited above and here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials. Typical useful incorporated hardeners (forehardeners) include those described in *Research Disclosure,* Item 17643, cited above, Paragraph X.

The present invention is equally applicable to photographic elements intended to form negative or positive images. For example, the photographic elements can be of a type which form either surface or internal latent images on exposure and which produce negatively images on processing. Alternatively, the photographic elements can be of a type that produce direct positive images in response to a single development step. When the composite grains comprised of the host tabular grain and the silver salt epitaxy form an internal latent image, surface fogging of the composite grains can be undertaken to facilitate the formation of a direct positive image. In a specifically preferred form the silver salt epitaxy is chosen to form an internal latent image site (i.e., to trap electrons internally ) and surface fogging can, if desired, be limited to just the silver salt epitaxy. In another form the host tabular grain can trap electrons internally with the silver salt epitaxy preferably acting as a hole trap. The surface fogged emulsions can be employed in combination with an organic electron acceptor as taught, for example, by Kendall et al U.S. Pat. No. 2,541,472, Shouwenaars U.K. Pat. No. 723,019, Illingsworth U.S. Pat. Nos. 3,501,305, '306, and '307, Research Disclosure, Vol, 134, June, 1975, Item 13452, Kurz U.S. Pat. No. 3,672,900, Judd et al U.S. Pat. No. 3,600,180, and Taber et al U.S. Pat. No. 3,647,643. The organic electron acceptor can be employed in combination with a spectrally sensitizing dye or can itself be a spectrally sensitizing dye, as illustrated by Illingsworth et al U.S. Pat. No. 3,501,310. If internally sensitive emulsions are employed, surface fogging and organic electron acceptors can be employed in combination as illustrated by Lincoln et al U.S. Pat. No. 3,501,311, but neither surface fogging nor organic electron acceptors are required to produce direct positive images.

In addition to the specific features described above, the photographic elements of this invention can employ conventional features, such as disclosed in *Research Disclosure,* Item 17643, cited above and here incorporated by reference. Optical brighteners can be introduced, as disclosed by Paragraph V. Antifoggants and sensitizers can be incorporated, as disclosed by Paragraph VI. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the high aspect ratio tabular grain emulsions of the present invention, preferably with each other or other silver iodide emulsions, to satisfy specific emulsion layer requirements. For example, it is known to blend emulsions to adjust the characteristic curve of a photographic element to satisfy a predetermined performance aim. Blending can be employed to increase or decrease maximum densities realized on exposure and processing, to decrease or increase minimum density, and to adjust characteristic curve shape intermediate its toe and shoulder.

In their simplest form photographic elements according to the present invention employ a single silver halide emulsion layer containing a high aspect ratio tabular grain emulsion according to the present invention and a photographic support. It is, of course, recognized that more than one silver halide emulsion layer as well as overcoat, subbing, and interlayers can be usefully included. Instead of blending emulsions as described above the same effect can usually by achieved by coating the emulsions to be blended as separate layers. Coating of separate emulsion layers to achieve exposure latitude is well known in the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower silver halide emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface. Typical of useful paper and polymeric film supports are those disclosed in *Research Disclosure,* Item 17643, cited above, Paragraph XVII.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application WO80/01614, published Aug. 7, 1980, (Belgian Pat. No. 881,513, Aug. 1, 1980, corresponding), Blazey et al U.S. Pat. No. 4,307,165, and Gilmour et al U.S. Pat. No. 4,411,973, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record green, red, or infrared exposures, spectral sensitizer absorbing in the green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques known in the art, such as those described in *Research Disclosure,* Item 17643, cited above, Paragraph XIX, can be readily adapted for use with the photographic elements of the present invention.

Once a silver image has been formed in the photographic element, it is conventional practice to fix the undeveloped silver halide. The high aspect ratio tabular grain emulsions of the present invention are particularly advantageous in allowing fixing to be accomplished in a shorter time period. This allows processing to be accelerated.

The photographic elements and the techniques described above for producing silver images can be readily adapted to provide a colored image through the selective destruction, formation, or physical removal of dyes, such as described in *Research Disclosure,* Item 17643, cited above, Paragraph VII, Color Materials. Processing of such photographic elements can take any convenient form, such as described in Paragraph XIX, Processing.

The emulsions and photographic elements of the present invention as well as the manner in which they are processed can be varied, depending upon the specific photographic application. Described below are certain preferred applications which are made possible by the distinctive properties of the emulsions and photographic elements of this invention.

In a specific preferred application the emulsions of this invention are used to record imagewise exposures to the blue portion of the visible spectrum. Since silver iodide possesses a very high level of absorption of blue light in the spectral region of less than about 430 nanometers, in one application of this invention the silver iodide grains can be relied upon to absorb blue light of 430 nanometers or less in wavelength without the use of a blue spectral sensitizing dye. A silver iodide tabular grain is capable of absorbing most of the less than 430 nanometer blue light incident upon it when it is at least about 0.1 micron in thickness and substantially all of such light when it is at least about 0.15 micron in thickness. (In coating emulsion layers containing high aspect ratio tabular grains the grains spontaneously align themselves so that their major crystal faces are parallel to the support surface and hence perpendicular to the direction of exposing radiation. Hence exposing radiation seeks to traverse the thickness of the tabular grains.)

The blue light absorbing capability of tabular silver iodide grains is in direct contrast to the light absorbing capability of the high aspect ratio tabular grain emulsions of other silver halide compositions disclosed in the copending, commonly assigned patent applications cited above. The latter exhibit markedly lower levels of blue light absorption even at thicknesses up to 0.3 micron. Kofron et al, for instance, specifically teaches to increase tabular grain thicknesses up to 0.5 micron to increase blue light absorption. Further, it should be noted that the tabular grain thicknesses taught by Kofron et al take into account that the emulsion layer will normally be coated with a conventional silver coverage, which is sufficient to provide many layers of superimposed tabular grains, whereas the 0.1 and 0.15 micron thicknesses above are for a single grain. It is therefore apparent that not only can tabular silver iodide grains according to this invention be used without blue spectral sensitizers, but they permit blue recording emulsion layers to be reduced in thickness (thereby increasing sharpness) and reduced in silver coverage. In considering this application of the invention further it can be appreciated that tabular grain silver iodide emulsions, provided minimal grain thicknesses are satisfied, absorb blue light as a function of the projected area which they present to exposing radiation. This is a fundamental distinction over other silver halides, such as silver bromide and silver bromoiodide, which in the absence of blue sensitizers absorb blue light as a function of their volume.

Not only are the high aspect ratio tabular grain silver iodide emulsions of the present invention more efficient in absorbing blue light than high aspect ratio tabular grains of differing halide composition, they are more efficient than conventional silver iodide emulsions containing nontabular grains or lower average aspect ratio tabular grains. At a silver coverage chosen to employ the blue light absorbing capability of the high aspect ratio tabular grains of this invention efficiently conventional silver iodide emulsions present lower projected areas and hence are capable of reduced blue light absorption. They also capture fewer photons per grain and are of lower photographic speed than the emulsions of the present invention, other parameters being comparable. If the average diameters of the conventional silver iodide grains are increased to match the projected areas presented by the high aspect ratio tabular grain silver halide emulsions of this invention, the conventional grains become much thicker than the tabular grains of this invention, require higher silver coverages to achieve comparable blue absorption, and are in general less efficient.

Although emulsions according to the present invention can be used to record blue light exposures without the use of spectral senstizing dyes, it is appreciated that the native blue absorption of silver iodide is not high over the entire blue region of the spectrum. To achieve a photographic response over the entire blue region of the spectrum it is specifically contemplated to employ emulsions according to the present invention which contain also one or more blue sensitizing dyes. The dye preferably exhibits an absorption peak of a wavelength longer than 430 nanometers so that the absorption of the silver iodide forming the tabular grains and the blue sensitizing dye together extend over a larger portion of the blue spectrum.

While silver iodide and a blue sensitizing dye can be employed in combination to provide a photographic response over the entire blue portion of the spectrum, if the silver iodide grains are chosen as described above for recording blue light efficiently in the absence of spectral sensitizing dye, the result is a highly unbalanced sensitivity. The silver iodide grains absorb substantially all of the blue light of a wavelength of less than 430 nanometers while the blue sensitizing dye absorbs only a fraction of the blue light of a wavelength longer than 430. To obtain a balanced sensitivity over the entire blue portion of the spectrum it contemplated to reduce the efficiency of the silver iodide grains in absorbing light of less than 430 nanometers in wavelength. This can be accomplished by reducing the average thickness of the tabular grains so that they are less than 0.1 micron in thickness. The optimum thickness of the tabular grains for a specific application is selected so that absorption above and below 430 nanometers is substantially matched. This will vary as a function of the spectral sensitizing dye or dyes employed.

Useful blue spectral sensitizing dyes for the high aspect ratio tabular grain silver emulsions of this invention can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics. In the formulae which follow, unless otherwise specified, alkyl groups and moieties contain from 1 to 20 carbon atoms, preferably from 1 to 8 carbon atoms. Aryl groups and moieties contain from 6 to 15 carbon atoms and are preferably phenyl or naphthyl groups or moieties.

Preferred cyanine blue spectral sensitizers are monomethine cyanines; however, useful cyanine blue spectral sensitizers can be selected from among those of Formula 1.

Formula 1

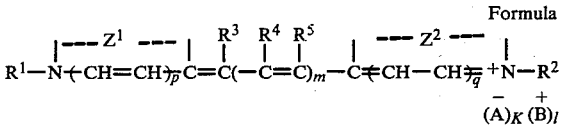

where $Z^1$ and $Z^2$ may be the same or different and each represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), thiazoline, thiazole, benzothiazole, the naphthothiazoles (e.g., naphtho[2,1-d]thiazole), the thiazoloquinolines (e.g., thiazolo[4,5-b]quinoline), selenazoline, selenazole, benzoselenazole, the naphthoselenazoles (e.g., naphtho[1,2-d]selenazole), 3H-indole (e.g., 3,3-dimethyl-3H-indole), the benzindoles (e.g., 1,1-dimethylbenz-[e]indole), imidazoline, imidazole, benzimidazole, the naphthimidazoles (e.g., naphth[2,3-d]imidazole), pyridine, and quinoline, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 3-sulfopropyl, carboxymethyl, 2-cyanoethyl, and trifluoromethyl), aryl groups or substituted aryl groups (e.g., phenyl, 1-naphthyl, 2-naphthyl, 4-sulfophenyl, 3-carboxyphenyl, and 4-biphenyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolythio, and 2-naphthylthio), methylenedioxy, cyano, 2-thienyl, styryl, amino or substituted amino groups (e.g., anilino, dimethylamino, diethylamino, and morpholino), acyl groups, such as carboxy (e.g., acetyl and benzoyl) and sulfo;

$R^1$ and $R^2$ can be the same or different and represent alkyl groups, aryl groups, alkenyl groups, or aralkyl groups, with or without substituents, (e.g., carboxymethyl, 2-hydroxyethyl, 3-sulfopropyl, 3-sulfobutyl, 4-sulfobutyl, 4-sulfophenyl, 2-methoxyethyl, 2-sulfatoethyl, 3-thiosulfatopropyl, 2-phosphonoethyl, chlorophenyl, and bromophenyl);

$R^3$ represents hydrogen;

$R^4$ and $R^5$ represents hydrogen or alkyl of from 1 to 4 carbon atoms;

p and q are 0 or 1, except that both p and q preferably are not 1;

m is 0 or 1 except that when m is 1 both p and q are 0 and at least one of $Z^1$ and $Z^2$ represents imidazoline, oxazoline, thiazoline, or selenazoline;

A is an anionic group;

B is a cationic group; and k and l may be 0 or 1, depending on whether ionic substituents are present. Variants are, of course, possible in which $R^1$ and $R^3$, $R^2$ and $R^5$, or $R^1$ and $R^2$ (particularly when m, p, and q are 0) together represent the atoms necessary to complete an alkylene bridge.

Some representative cyanine dyes useful as blue sensitizers are listed in Table I.

TABLE I 1. 3,3'-Diethylthiacyanine bromide

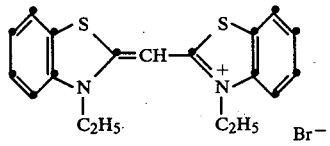

2. 3-Ethyl-3'-methyl-4'-phenylnaphtho[1,2-d]thiazolothiazolinocyanine bromide

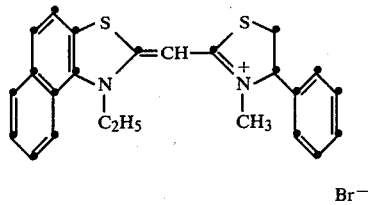

3. 1',3-Diethyl-4-phenyloxazolo-2'-cyanine iodide

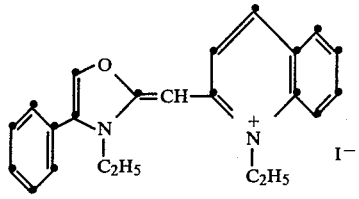

4. Anhydro 5-chloro-5'-methoxy-3,3'-bis-(2-sulfoethyl)thiacyanine hydroxide, triethylamine salt TABLE I-continued

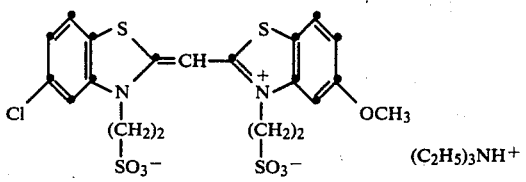

5. 3,3'-Bis(2-carboxyethyl)thiazolinocarbocyanine iodide

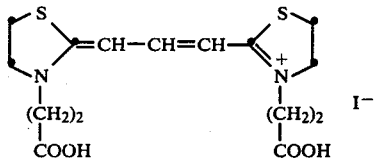

6. 1,1'-Diethyl-3,3'-ethylenebenzimidazolocyanine iodide

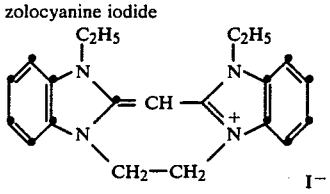

7. 1-(3-Ethyl-2-benzothiazolinyldiene)-1,2,3,4-tetrahydro-2-methylpyrido-[2,1-b]-benzothiazolinium iodide

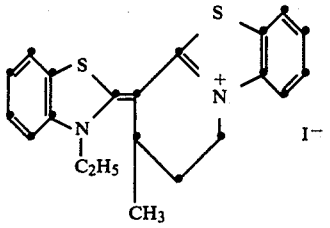

8. Anhydro-5,5'-dimethoxy-3,3'-bis(3-sulfopropyl)thiacyanine hydroxide, sodium salt

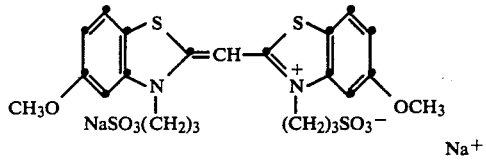

Preferred merocyanine blue spectral sensitizers are zero methine merocyanines; however, useful merocyanine blue spectral sensitizers can be selected from among those of Formula 2.

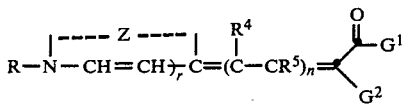

Formula 2

Formula 2 where

Z represents the same elements as either $Z^1$ or $Z^2$ of Formula 1 above;

R represents the same groups as either $R^1$ or $R^2$ of Formula 1 above;

$R^4$ and $R^5$ represent hydrogen, an alkyl group of 1 to 4 carbon atoms, or an aryl group (e.g., phenyl or naphthyl);

$G^1$ represents an alkyl group or substituted alkyl group, an aryl or substituted aryl group, an aralkyl group, an alkoxy group, an aryloxy group, a hydroxy group, an amino group, a substituted amino group wherein specific groups are of the types in Formula 1;

$G^2$ can represent any one of the groups listed for $G^1$ and in addition can represent a cyano group, an alkyl, or arylsulfonyl group, or a group represented by

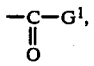

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl-2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)rhodanine, and 3-carboxymethylrhodanine, hydantoin (e.g., 1,3-diethylhydantoin and 3-ethyl-1-phenylhydantoin), 2-thiohydantoin (e.g., 1-ethyl-3-phenyl-2-thiohydantoin, 3-heptyl-0 1-phenyl-2-thiohydantoin, and 1,3-diphenyl-2-thiohydantoin), 2-pyrazolin-5-one, such as 3-methyl-1-phenyl-2-pyrazolin-5-one, 3-methyl-1-(4-carboxybutyl)-2-pyrazolin-5-one, and 3-methyl-2-(4-sulfophenyl)-2-pyrazolin-5-one, 2-isoxazolin-5-one (e.g., 3-phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione, 1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid);

r and n each can be 0 or 1 except that when n is 1 then generally either Z is restricted to imidazoline, oxazoline, selenazoline, thiazoline, imidazoline, oxazole, or benzoxazole, or $G^1$ and $G^2$ do not represent a cyclic system. Some representative blue sensitizing merocyanine dyes are listed below in Table II.

TABLE II 1. 5-(3-Ethyl-2-benzoxazolinylidene)-3-phenylrhodanine

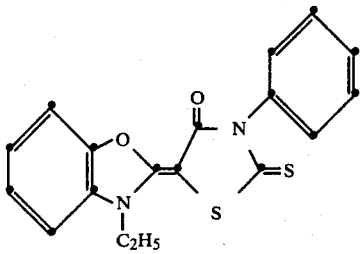

2. 5-[1-(2-Carboxyethyl)-1,4-dihydro-4-pyridinylidene]-1-ethyl-3-phenyl-2-thiohydantoin TABLE II-continued

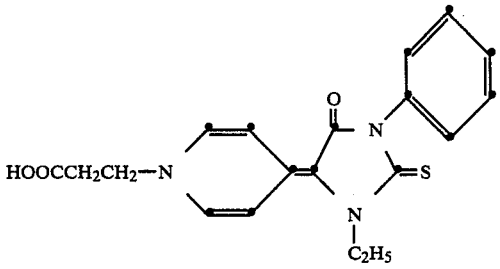

3. 4-(3-Ethyl-2-benzothiazolinylidene)-3-methyl-1-(4-sulfophenyl)-2-pyrazolin-5-one, Potassium Salt

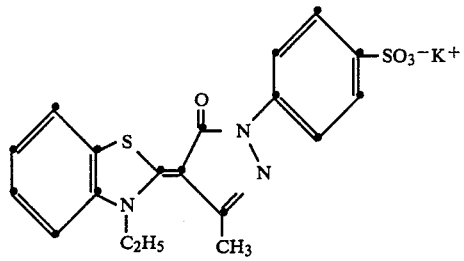

4. 3-Carboxymethyl-5-(5-chloro-3-ethyl-2-benzothiazolinylidene)rhodanine

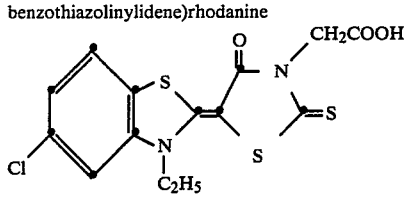

5. 1,3-Diethyl-5-[3,4,4-trimethyloxazolidinylidene)ethylidene]-2-thiobarbituric acid

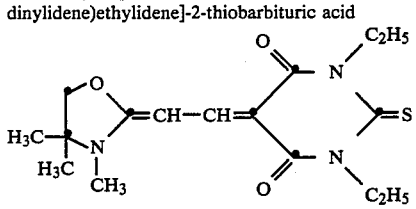

Useful blue sensitizing hemicyanine dyes include those represented by Formula 3.

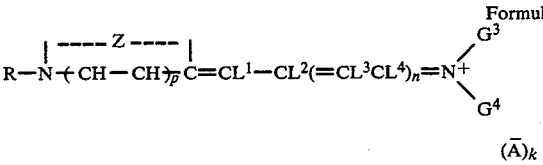

Formula 3 where

Z, R, and p represent the same elements as in Formula 2; $G^3$ and $G^4$ may be the same or different and may represent alkyl, substituted alkyl, aryl, substituted aryl, or aralkyl, as illustrated for ring substituents in Formula 1 or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4-tetrahydroquinoline, decahydroquinoline, 3-azabicyclo[3,2,2]nonane, indoline, azetidine, and hexahydroazepine;

$L^1$ to $L^4$ represent hydrogen, alkyl of 1 to 4 carbons, aryl, substituted aryl, or any two of $L^1$, $L^2$, $L^3$, $L^4$ can represent the elements needed to complete an alkylene or carbocyclic bridge;

n is 0 or 1; and

A and k have the same definition as in Formula 1.

Some representative blue sensitizing hemicyanine dyes are listed below in Table III.

TABLE III 1. 5,6-Dichloro-2-[4-(diethylamino)-1,3-butadien-1-yl]-1,3-diethylbenzimidazolium iodide

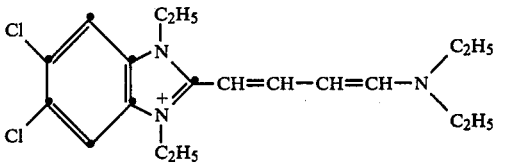

2. 2-{2-[2-(3-Pyrrolino)-1-cyclopenten-1-yl]-ethenyl}-3-ethylthiazolium perchlorate

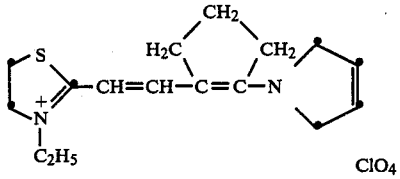

3. 2-(5,5-Dimethyl-3-piperidino-2-cyclohexen-1-yldenemethyl)-3-ethylbenzoxazolium perchlorate

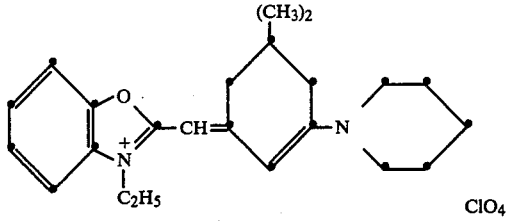

Useful blue sensitizing hemioxonol dyes include those represented by Formula 4.

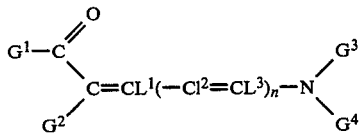

Formula 4 where $G^1$ and $G^2$ represent the same elements as in Formula 2;

$G^3$, $G^4$, $L^1$, $L^2$, and $L^3$ represent the same elements as in Formula 3; and n is 0 or 1.

Some representative blue sensitizing hemioxonol dyes are listed in Table IV.

TABLE IV 1. 5-(3-Anilino-2-propen-1-ylidene)-1,3-diethyl-2-thiobarbituric acid

TABLE IV-continued

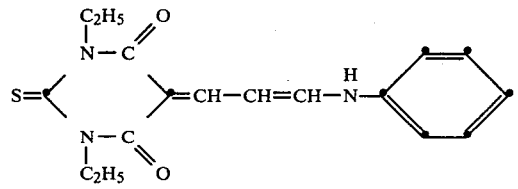

2. 3-Ethyl-5-(3-piperidino-2-propen-1-ylidene)rhodanine

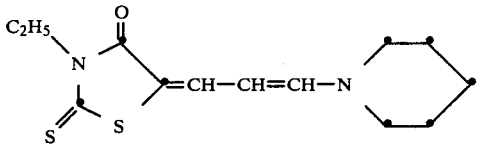

3. 3-Allyl-5-[5,5-dimethyl-3-(3-pyrrolino)-2-cyclohexen-1-ylidene]rhodanine

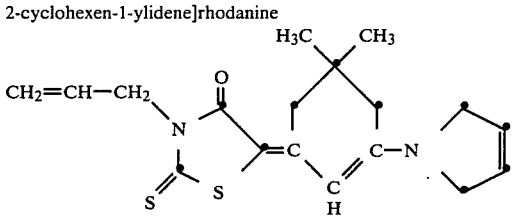

Useful blue sensitizing merostyryl dyes include those represented by Formula 5.

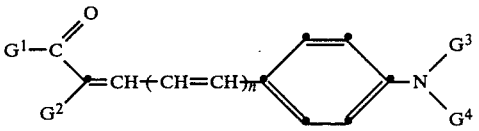

Formula 5 where $G^1$, $G^2$, $G^3$, $G^4$, and n are as defined in Formula 4.

Some representative blue sensitizing merostyryl dyes are listed in Table V.

TABLE V 1. 1-Cyano-1-(4-dimethylaminobenzylidene)-2-pentanone

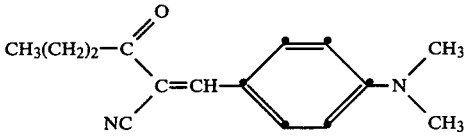

2. 5-(4-Dimethylaminobenzylidene-2,3-diphenylthiazolidin-4-one-1-oxide

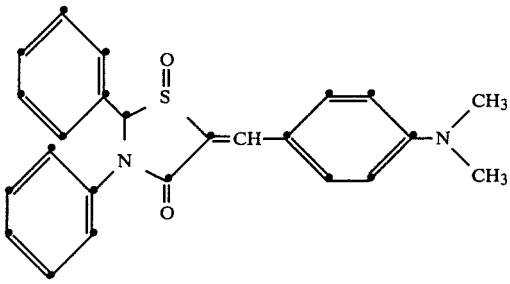

3. 2-(4-Dimethylaminocinnamylidene)thiazolo-[3,2-a]benzimidazol-3-one

TABLE V-continued

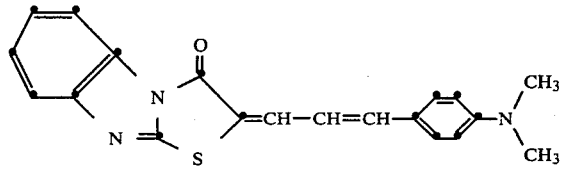

It is known in the art that the granularity of a silver halide emulsion generally increases as a function of the size of the grains. The maximum permissible granularity is a function of the particular photographic application contemplated. Thus, in general the silver iodide high aspect ratio tabular grains of this invention can have average diameters ranging up to 30 microns, although average diameters of less than 20 microns are preferred, and average diamters of less than 10 microns are optimum for most photographic applications.

In some photographic applications extremely high resolution capabilities are required. High resolution silver halide emulsions are, for example, frequently employed for recording astronomical observations, although they are by no means limited to such applications. Typically high resolution emulsions have average grain diameters of less than 0.1 micron. Achieving such low average grain diameters with high aspect ratio tabular grain silver halide emulsions such as those described by the copending, commonly patent applications cited has not been achieved, since the minimum reported grain thicknesses preclude simultaneously achieving high aspect ratios and such small average grain diameters. In view of the much lower minimum tabular grain thicknesses achievable with the present invention, it is possible to obtain high resolution emulsions having average grain diameters of less than 0.2 micron and also high average aspect ratios. This allows advantages of high average aspect ratios to be carried over and applied to high resolution photographic emulsions.

As indicated above, there are distinct advantages to be realized by epitaxially depositing silver chloride onto the silver iodide host grains. Once the silver chloride is epitaxially deposited, however, it can be altered in halide content by substituting less soluble halide ions in the silver chloride crystal lattice. Using a conventional halide conversion process bromide and/or iodide ions can be introduced into the original silver chloride crystal lattice. Halide conversion can be achieved merely by bringing the emulsion comprised of silver iodide host grains bearing silver chloride epitaxy into contact with an aqueous solution of bromide and/or iodide salts. An advantage is achieved in extending the halide compositions available for use while retaining the advantages of silver chloride epitaxial deposition. Additionally, the converted halide epitaxy forms an internal latent image. This permits the emulsions to be applied to photographic applications requiring the formation of an internal latent image, such as direct positive imaging. Further advantages and features of this form of the invention can be appreciated by reference to Maskasky U.S. Pat. No. 4,142,900, here incorporated by reference.

When the silver salt epitaxy is much more readily developed than the silver iodide host grains, it is possible to control whether the silver salt epitaxy alone or the entire composite grain develops merely by controlling the choice of developing agents and the conditions of development. With vigorous developing agents, such as hydroquinone, catechol, halohydroquinone, N-methylaminophenol sulfate, 3-pyrazolidinone, and mixtures thereof, complete development of the composite silver halide grains can be achieved. Maskasky U.S. Pat. No. 4,094,684, cited above and here incorporated by reference, illustrates that under certain mild development conditions it is possible to develop selectively silver chloride epitaxy while not developing silver iodide host grains. Development can be specifically optimized for maximum silver development or for selective development of epitaxy, which can result in reduced graininess of the photographic image. Further, the degree of silver iodide development can be controlled to control the release of iodide ions, which can be used to inhibit development.

In a specific application of this invention a photographic element can be constructed incorporating a uniform distribution of a redox catalyst in addition to at least one layer containing an emulsion according to the present invention. When the silver iodide grains are imagewise developed, iodide ion is released which locally poisons the redox catalyst. Thereafter a redox reaction can be catalyzed by the unpoisoned catalyst remaining. Bissonette U.S. Pat. No. 4,089,685, here incorporated by reference, specifically illustrates a useful redox system in which a peroxide oxidizing agent and a dye-image-generating reducing agent, such as a color developing agent or redox dye-releasor, react imagewise at available, unpoisoned catalyst sites within a photographic element. Maskasky U.S. Patent No. 4,158,565, here incorporated by reference, discloses the use of silver iodide host grains bearing silver chloride epitaxy in such a redox amplification system.

EXAMPLES

The invention is further illustrated by the following examples. In each of the examples the contents of the reaction vessel were stirred vigorously throughout silver and iodide salt introductions; the term "percent" means percent by weight, unless otherwise indicated; and the term "M" stands for a molar concentration, unless otherwise stated. All solutions, unless otherwise stated, are aqueous solutions.

EXAMPLE EMULSION 1

Tabular Grain Silver Iodide Emulsion 6.0 liters of a 5 percent deionized bone gelatin aqueous solution were placed in a precipitation vessel and stirred at pH 4.0 and pAg calculated at 1.6 at 40° C. A 2.5 molar potassium iodide solution and a 2.5 molar silver nitrate solution were added for 5 minutes by double-jet addition at a constant flow rate consuming 0.13 percent of the silver used. Then the solutions were added for 175 minutes by accelerated flow (44X from start to finish) consuming 99.87 percent of the silver used. Silver iodide in the amount of 5 moles was precipitated.

The emulsion was centrifuged, resuspended in distilled water, centrifuged, resuspended in 1.0 liters of a 3 percent gelatin solution and adjusted to pAg 7.2 measured at 40° C. The resultant tabular grain silver iodide emulsion had an average grain diameter 0.84 μm, an average grain thickness of 0.066 μm, an aspect ratio of 12.7:1, and greater than 80 percent of the grains were tabular based on projected area. Using X-ray powder diffraction analysis greater than 90 percent of the silver iodide was estimated to be present in the γ phase. See FIG. 1 for a carbon replica electron micrograph of a sample of the emulsion.

EXAMPLE EMULSION 2

Figure 2:
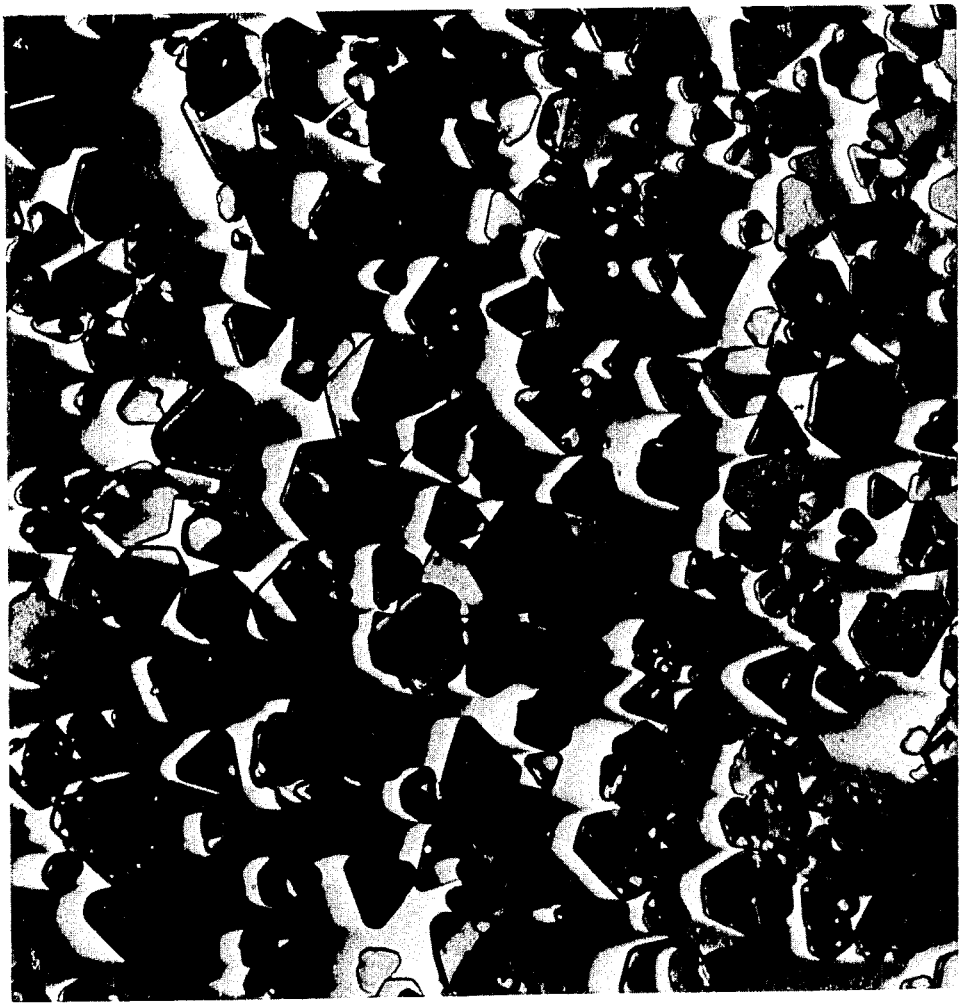

Epitaxial AgCl on Tabular Grain AgI Emulsion 29.8 g of the tabular grain AgI emulsion (0.04 mole) prepared in Example 1 was brought to a final weight of 40.0 g with distilled water and placed in a reaction vessel. The pAg was measured as 7.2 at 40° C. Then 10 mole percent silver chloride was precipitated onto the AgI host emulsion by double-jet addition for approximately 16 minutes of a 0.5 molar NaCl solution and a 0.5 molar $AgNO_3$ solution at 0.5 ml/minute. The pAg was maintained at 7.2 throughout the run. See FIG. 2 for a carbon replica electron micrograph of a sample of the emulsion.

EXAMPLE EMULSION 3

Epitaxial AgCl plus Iridium on Tabular Grain AgI Emulsion

Emulsion 3 was prepared similarly to the epitaxial AgCl tabular grain AgI emulsion of Example 2 with the exception that 15 seconds after the start of the silver salt and halide salt solutions 1.44 mg of an iridium compound/Ag mole was added to the reaction vessel.

Example Emulsions 1, 2 and 3 were each coated on a polyester film support at 1.73 g silver/$m^2$ and 3.58 g gelatin/$m^2$. The coatings were overcoated with 0.54 g gelatin/$m^2$ and contained 2.0 percent bis(vinylsulfonylmethyl)ether hardener based on total gelatin content. The coatings were exposed for ½ second to a 600 W 2850° K. tungsten light source through a 0–6.0 density step tablet (0.30 steps) and processed for 6 minutes at 20° C. in a total (surface+internal) developer of the type described by Weiss et al U.S. Pat. No. 3,826,654.

Sensitometric results reveal that for the tabular grain AgI host emulsion (Emulsion 1) no discernible image was obtained. However, for the epitaxial AgCl (10 mole percent)/tabular grain AgI emulsion (Emulsion 2), a significant negative image was obtained with a D-min of 0.17, a D-max of 1.40, and a contrast of 1.7. For the iridium sensitized epitaxial AgCl (10 mole percent)-/tabular grain AgI emulsion (Emulsion 3) a negative image was obtained with a D-min of 0.19, a D-max of 1.40, a contrast of 1.2, and approximately 0.5 log E faster in threshold speed than Emulsion 2.

EXAMPLE EMULSION 4

The Use of Phosphate to Increase the Size of AgI Tabular Grains

This emulsion was prepared similar to Example Emulsion 1 except that it contained 0.011 molar $K_2HPO_4$ in the precipitation vessel and 0.023 molar $K_2HPO_4$ in the 2.5 molar potassium iodide solution.

The resultant tabular grain emulsion was found to consist of silver iodide. No phosphorus was detectable using x-ray microanalysis. The AgI tabular grain emulsion had an average grain diameter of 1.65 μm compared to 0.84 μm found for Example Emulsion 1, an average grain thickness of 0.20 μm, an aspect ratio fo 8.3:1, and greater than 70 percent of the grains were tabular based on projected area. Greater than 90 percent of the silver iodide was present in the γ phase as determined by X-ray powder diffraction analysis.

The invention has been described in detail with particular reference to preferred embodiments thereof, but it will be understood that variations and modifications can be effected within the spirit and scope of the invention.

What is claimed is:

1. A high aspect ratio tabular grain silver halide emulsion comprised of a dispersing medium and silver halide grains, wherein at least 50 percent of the total projected area of said silver halide grains is provided by tabular silver iodide grains of a face centered cubic crystal structure having a thickness of less than 0.3 micron and an average aspect ratio of greater than 8:1.

2. An emulsion according to claim 1 wherein said tabular silver iodide grains have an average aspect ratio of at least 12:1.

3. An emulsion according to claim 1 wherein said dispersing medium is a peptizer.

4. An emulsion according to claim 3 wherein said peptizer is gelatin or a gelatin derivative.

5. An emulsion according to claim 1 wherein said tabular silver iodide grains account for at least 70 percent of the total projected area of said silver halide grains.

6. An emulsion according to claim 1 wherein silver salt is epitaxially located on said tabular silver iodide grains.

7. An emulsion according to claim 6 wherein said silver salt is a silver halide.

8. An emulsion according to claim 7 wherein said silver salt is comprised of silver chloride.

9. An emulsion according to claim 7 wherein said silver salt is comprised of silver bromide.

10. An emulsion according to claim 6 wherein said silver salt is comprised of silver thiocyanate.

11. An emulsion according to claim 6 wherein said silver salt is epitaxially located on less than 25 percent of the surface area provided by the major crystal faces of said tabular silver iodide grains.

12. An emulsion according to claim 11 wherein said silver salt is epitaxially located on less than 10 percent of the surface area provided by the major crystal faces of said tabular silver iodide grains.

13. An emulsion according to claim 6 wherein at least one of said silver salt and said tabular silver iodide grains contains a sensitivity modifier incorporated therein.

14. An emulsion according to claim 13 wherein said silver salt contains iridium incorporated therein.

15. An emulsion according to claim 1 wherein said tabular silver iodide grains have an average thickness of greater than 0.005 micron.

16. An emulsion according to claim 1 wherein said tabular silver iodide grains have an average thickness of greater than 0.01 micron.

17. An emulsion according to claim 1 wherein said tabular silver iodide grains have an average thickness of less than 0.1 micron and said emulsion additionally contains a blue spectral sensitizing dye having an absorption peak of a wavelength longer than 430 nanometers.

18. An emulsion according to claim 1 wherein said emulsion is a high resolution emulsion having an average grain diameter of less than 0.2 micron.

19. In a photographic element comprised of a support and at least one radiation-sensitive emulsion layer, the improvement wherein said emulsion layer is comprised of an emulsion according to any one of claims 1 through 18.

20. A process of producing a visible photographic image comprising processing in an aqueous alkaline solution in the presence of a developing agent an imagewise exposed photographic element according to claim 19.

* * * * *